US011349239B2

(12) United States Patent
Gundermann et al.

(10) Patent No.: US 11,349,239 B2
(45) Date of Patent: May 31, 2022

(54) TERMINAL WITH OFFSET CONNECTION SECTION

(71) Applicant: TE Connectivity Services GmbH, Schaffhausen (CH)

(72) Inventors: James Edward Gundermann, Middletown, PA (US); John Mark Myer, Middletown, PA (US); Hurley Chester Moll, Middletown, PA (US); Daniel Williams Fry, Jr., Middletown, PA (US); Christopher Lee Allgood, Winston Salem, NC (US); Michael Dale Brown, Winston Salem, NC (US); Eric Torrey, Troy, MI (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 17/081,253

(22) Filed: Oct. 27, 2020

(65) Prior Publication Data

US 2022/0131295 A1 Apr. 28, 2022

(51) Int. Cl.

| | |
|---|---|
| ***H01R 12/73*** | (2011.01) |
| ***H01R 13/08*** | (2006.01) |
| ***H01R 12/58*** | (2011.01) |

(52) U.S. Cl.

CPC ..... *H01R 12/737* (2013.01); *H01R 12/585* (2013.01); *H01R 13/08* (2013.01)

(58) Field of Classification Search

CPC ..... H01R 12/737; H01R 12/585; H01R 13/08
See application file for complete search history.

(56) References Cited

U.S. PATENT DOCUMENTS

| | | | | |
|---|---|---|---|---|
| 4,715,820 | A * | 12/1987 | Andrews, Jr. | H01R 12/737 439/59 |
| 4,857,018 | A * | 8/1989 | Pickles | H01R 12/585 439/751 |
| 4,929,193 | A * | 5/1990 | Taylor | H01R 13/428 439/567 |
| 5,727,957 | A * | 3/1998 | Hashimoto | H01R 12/725 439/83 |
| 6,095,826 | A * | 8/2000 | Potters | H01R 12/724 439/79 |
| 7,086,872 | B2 * | 8/2006 | Myer | H01R 12/714 439/78 |
| 7,086,913 | B2 * | 8/2006 | Myer | H01R 12/7005 439/876 |
| 8,523,581 | B2 | 9/2013 | Martin et al. | |
| 10,044,121 | B2 * | 8/2018 | Shimizu | H01R 12/585 |
| 10,230,192 | B2 * | 3/2019 | Peloza | H01R 13/4223 |
| 2020/0161801 | A1 * | 5/2020 | Chiba | H01R 13/502 |

FOREIGN PATENT DOCUMENTS

| | | | | |
|---|---|---|---|---|
| DE | 102012218433 | A1 * | 4/2014 | H01R 43/205 |

* cited by examiner

*Primary Examiner* — Travis S Chambers

(57) ABSTRACT

A terminal includes a first connection section having a first connection central axis extending centrally though the first connection section along a longitudinal direction and a shoulder having a first surface extending normal to the longitudinal direction at an end of the first connection section. The shoulder has a width greater than the first connection section in a width direction perpendicular to the longitudinal direction and has a shoulder central axis extending centrally though the shoulder along the longitudinal direction. The shoulder central axis is offset from the first connection central axis in the width direction.

16 Claims, 5 Drawing Sheets

TERMINAL WITH OFFSET CONNECTION SECTION

FIELD OF THE INVENTION

The present invention relates to a terminal and, more particularly, to a terminal having an offset connection section.

BACKGROUND

Electrical connectors commonly include a plurality of terminals positioned in a housing. The terminals, for example, each have pins protruding from the housing that are pressed into a printed circuit board to form an electrical connection with the printed circuit board. In order to insert the terminals into the housing, each of the terminals has a shoulder positioned at an end of the pin. The shoulder protrudes symmetrically on opposite sides of the pin. A tooling engages the shoulder on opposite sides of the pin to push the terminal into the housing.

Electrical connectors are increasingly required to be miniaturized to meet the requirements of modern applications. As the size of the electrical connector decreases, the terminals are positioned closer together, leaving less room for the tooling to push the terminal into the housing. When the terminals are set at a 2.2 mm pitch, for example, the tooling is only able to engage a small portion of the shoulder on each side of the pin, providing improper support for inserting the terminal into the housing that can lead to incomplete insertion or damage to the pin. Further, once inserted into the housing, the shoulders do not provide adequate support when pressing the pins into the printed circuit board, potentially leading to an incomplete electrical connection and/or damage to the pin.

SUMMARY

A terminal includes a first connection section having a first connection central axis extending centrally though the first connection section along a longitudinal direction and a shoulder having a first surface extending normal to the longitudinal direction at an end of the first connection section. The shoulder has a width greater than the first connection section in a width direction perpendicular to the longitudinal direction and has a shoulder central axis extending centrally though the shoulder along the longitudinal direction. The shoulder central axis is offset from the first connection central axis in the width direction.

BRIEF DESCRIPTION OF THE DRAWINGS

The invention will now be described by way of example with reference to the accompanying Figures, of which.

DETAILED DESCRIPTION OF THE EMBODIMENTS

Figure 1:
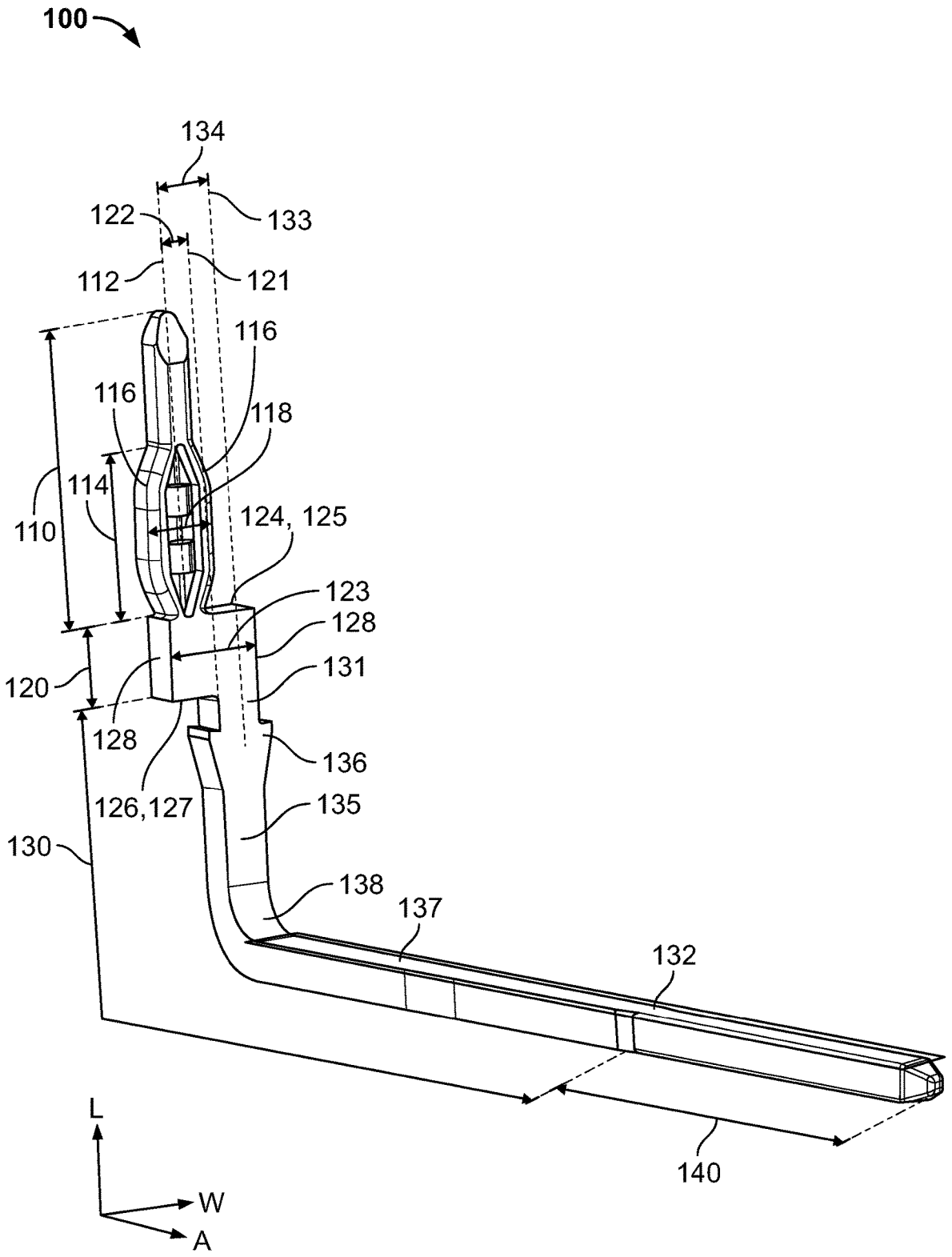
FIG. 1 is a perspective view of a terminal according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

A terminal 100 according to an embodiment is shown in FIG. 1. The terminal 100 comprises a first connection section 110, a shoulder 120 connected to the first connection section 110, a retention section 130 connected to the shoulder 120, and a second connection section 140 connected to the retention section 130.

The first connection section 110, as shown in FIG. 1, has a first connection central axis 112 extending centrally through the first connection section 110 along a longitudinal direction L. The first connection section 110 is adapted to form an electrical connection with a first external component. In the shown embodiment, the first connection section 110 is a compliant pin having an elastic press-fit portion 114. In the shown embodiment, the first connection section 110 is a multispring pin. The first connection section 110 has a connection width 118 in a width direction W perpendicular to the longitudinal direction L.

The elastic press-fit portion 114, as shown in FIG. 1, has a pair of deformable legs 116 arched in the width direction W. The pair of deformable legs 116 are elastically or plastically deformable when in contact with the first external component to form the electrical connection between the first connection section 110 and the first external component.

The shoulder 120, as shown in FIG. 1, is connected to an end of the first connection section 110 in the longitudinal direction L. The shoulder 120 is a rectangular member and has a shoulder width 123 that is greater than the connection width 118 of the first connection section 110 in the width direction W. The shoulder 120 has a shoulder central axis 121 extending centrally through the shoulder 120 along the longitudinal direction L. The shoulder central axis 121 is offset from the first connection central axis 112 by a first offset distance 122 in the width direction W.

In the shown embodiment, the first offset distance 122 is less than half of the connection width 118 of the first connection section 110, and one of the deformable legs 116 of the first connection section 110 overlaps the shoulder central axis 121 in the width direction W. In another embodiment, the connection width 118 may be narrower in the width direction W than in the shown embodiment, and the deformable leg 116 protruding toward the shoulder central axis 121 may be spaced apart from the shoulder central axis 121 in the width direction W. In another embodiment, the first connection section 110 may be positioned on the shoulder 120 further from the shoulder central axis 121 in the width direction W, increasing the first offset distance 122 from the embodiment shown in FIG. 1. With a greater first offset distance 122, the deformable leg 116 protruding toward the shoulder central axis 121 may be spaced apart from the shoulder central axis 121 in the width direction W.

The shoulder 120, as shown in FIG. 1, has a first surface 124 extending normal to the longitudinal direction L at the end of the first connection section 110; the first connection section 110 is connected to the shoulder 120 at the first surface 124. The shoulder 120 has a second surface 126 opposite to the first surface 124 in the longitudinal direction and extending normal to the longitudinal direction L. The second surface 126 faces in a direction opposite the first surface 124.

In the embodiment shown in FIG. 1, the first surface 124 and the second surface 126 have a same thickness in an axial direction A perpendicular to the longitudinal direction L and the width direction W. In another embodiment, the first surface 124 and the second surface 126 may have different thicknesses along the axial direction A with, for example, the shoulder central axis 121 delineating the difference in thickness of the portions of the shoulder 120.

As shown in FIG. 1, the shoulder 120 has a pair of side surfaces 128 extending in the longitudinal direction L and connecting the first surface 124 to the second surface 126. The pair of side surfaces 128 face opposite to each other along the width direction W. In the shown embodiment, one of the deformable legs 116 of the elastic press-fit portion 114 extends beyond one of the side surfaces 128 in the width direction W. In other embodiments, such as with a different connection width 118 or a different first offset distance 122 as described above, one of the deformable legs 116 may be aligned with one of the side surfaces 128 in the width direction W. In the embodiment shown in FIG. 1, the side surfaces 128 have a same thickness in the axial direction A. In another embodiment, the side surfaces 128 may have different thicknesses along the axial direction A.

The retention section 130, as shown in FIG. 1, has a first end 131 connected to the second surface 126 of the shoulder 120 and a second end 132 opposite the first end 131. The retention section 130 has a retention central axis 133 extending centrally through the retention section 130 in the longitudinal direction L. The retention central axis 133 is offset from the both the first connection central axis 112 and the shoulder central axis 121 in the width direction W. The retention central axis 133 is offset from the first connection central axis 112 by a second offset distance 134. In the embodiment shown in FIG. 1, the second offset distance 134 is greater than the first offset distance 122.

In the embodiment shown in FIG. 1, the retention section 130 has a longitudinal portion 135 extending along the longitudinal axis L from the second surface 126 of the shoulder 120, a transverse portion 137 extending along the axial direction A, and a perpendicular bend portion 138 connecting the longitudinal portion 135 and the transverse portion 137. The retention section 130 has a pair of protrusions 136 extending from opposite sides of the longitudinal portion 135.

The embodiment shown in FIG. 1 of the longitudinal portion 135, the transverse portion 137, and the perpendicular bend portion 180 is merely exemplary; in other embodiments, the longitudinal portion 135 and the transverse portion 137 may have different relative lengths along the respective longitudinal direction L and axial direction A. In another embodiment, the retention section 130 may be straight and have only the longitudinal portion 135 without the transverse portion 137 and the perpendicular bend portion 138.

The second connection section 140, as shown in FIG. 1, is connected to the second end 132 of the retention section 130. The second connection section 140 is aligned with the retention section 130 along the axial direction A. The second connection section 140 is adapted to form an electrical connection with a second external component. In the shown embodiment, the second connection section 140 is a solid pin.

In the shown embodiment, the first connection section 110, the shoulder 120, the retention section 130, and the second connection section 140 are monolithically formed in a single piece. In another embodiment, the first connection section 110, the shoulder 120, the retention section 130, and the second connection section 140 may be formed in at least two separate pieces and assembled together. In an exemplary embodiment, the shoulder 120 is separated in the width direction W along the shoulder central axis 121 with a first portion of the shoulder 120 including the second surface 126 formed with the first connection section 110 and a second portion of the shoulder 120 including the first surface 124 formed with at least the first end 131 of the retention section 130. The first portion of the shoulder 120 is attachable to the second portion of the shoulder 120 along the shoulder central axis 121, for example, by welding or any other type of electrically conductive attachment. In other embodiments, the shoulder 120 may be separated along a different direction or any portions of the terminal 100 may be separated from one another and attached together to form the terminal 100.

Figure 2:
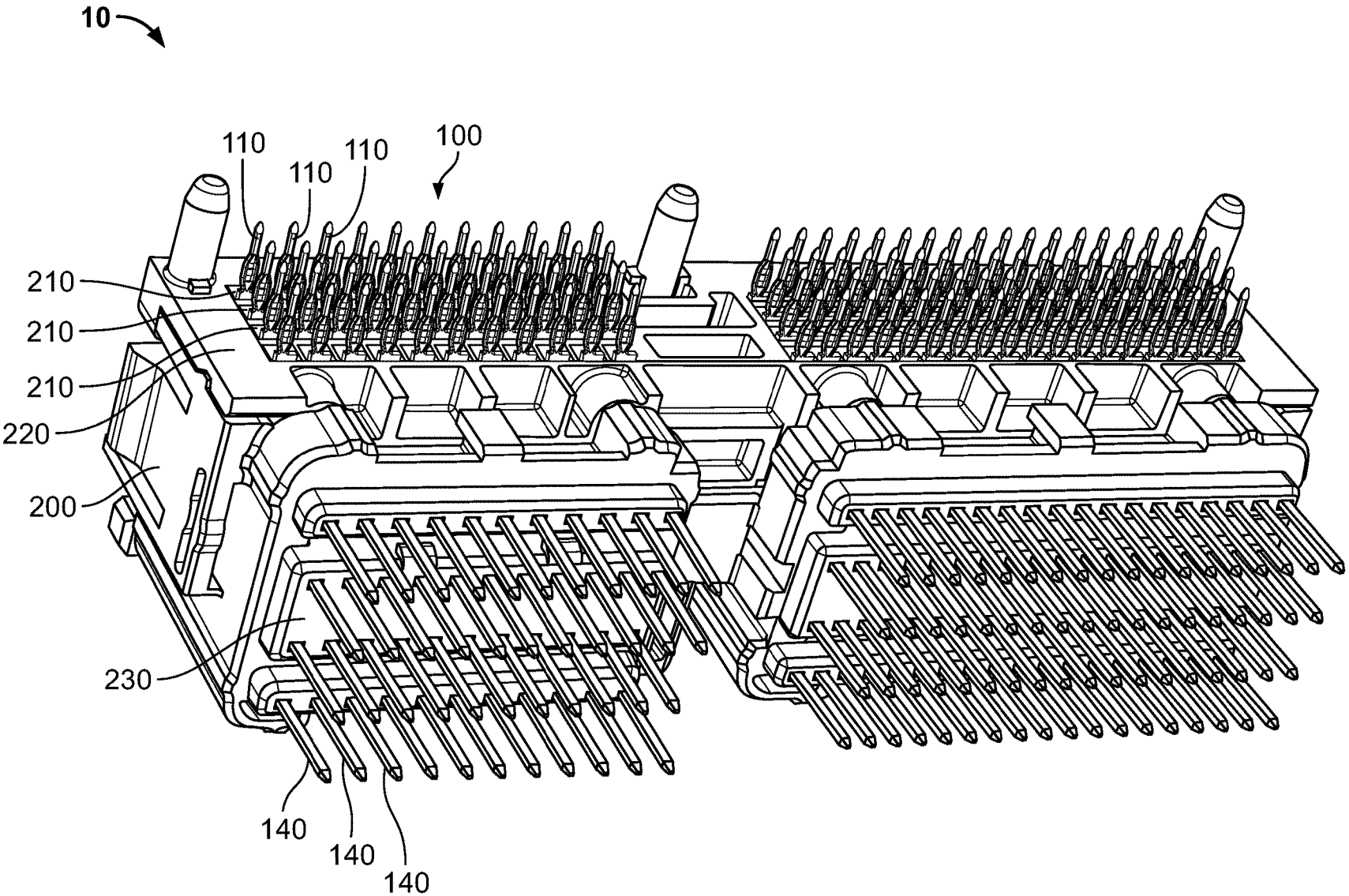
FIG. 2 is a perspective view of a connector including the terminal of FIG. 1 positioned in a housing according to an embodiment.
Figure 3:
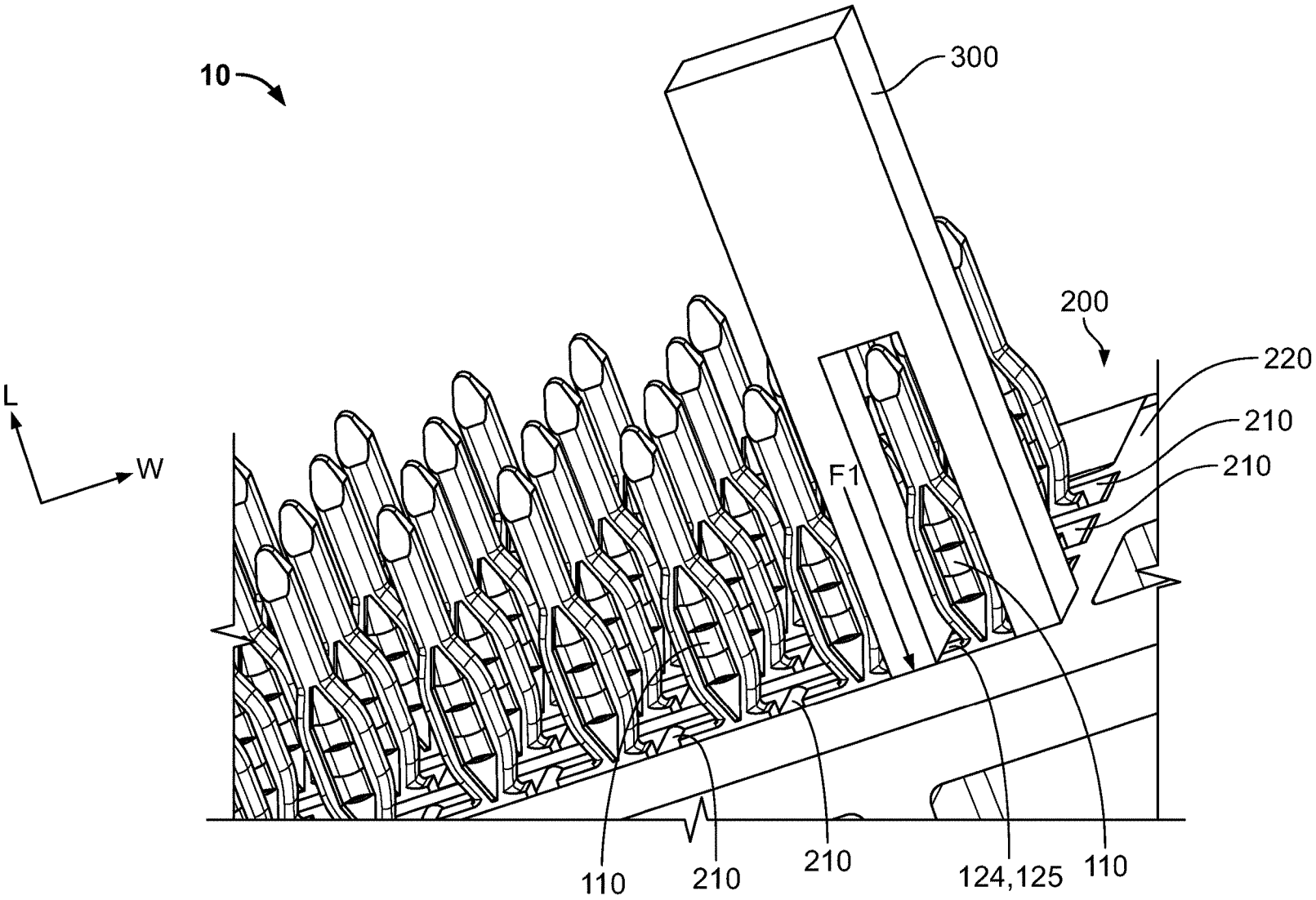
FIG. 3 is a detail perspective view of a tooling pressing the terminal of FIG. 1 into the housing.
Figure 4:
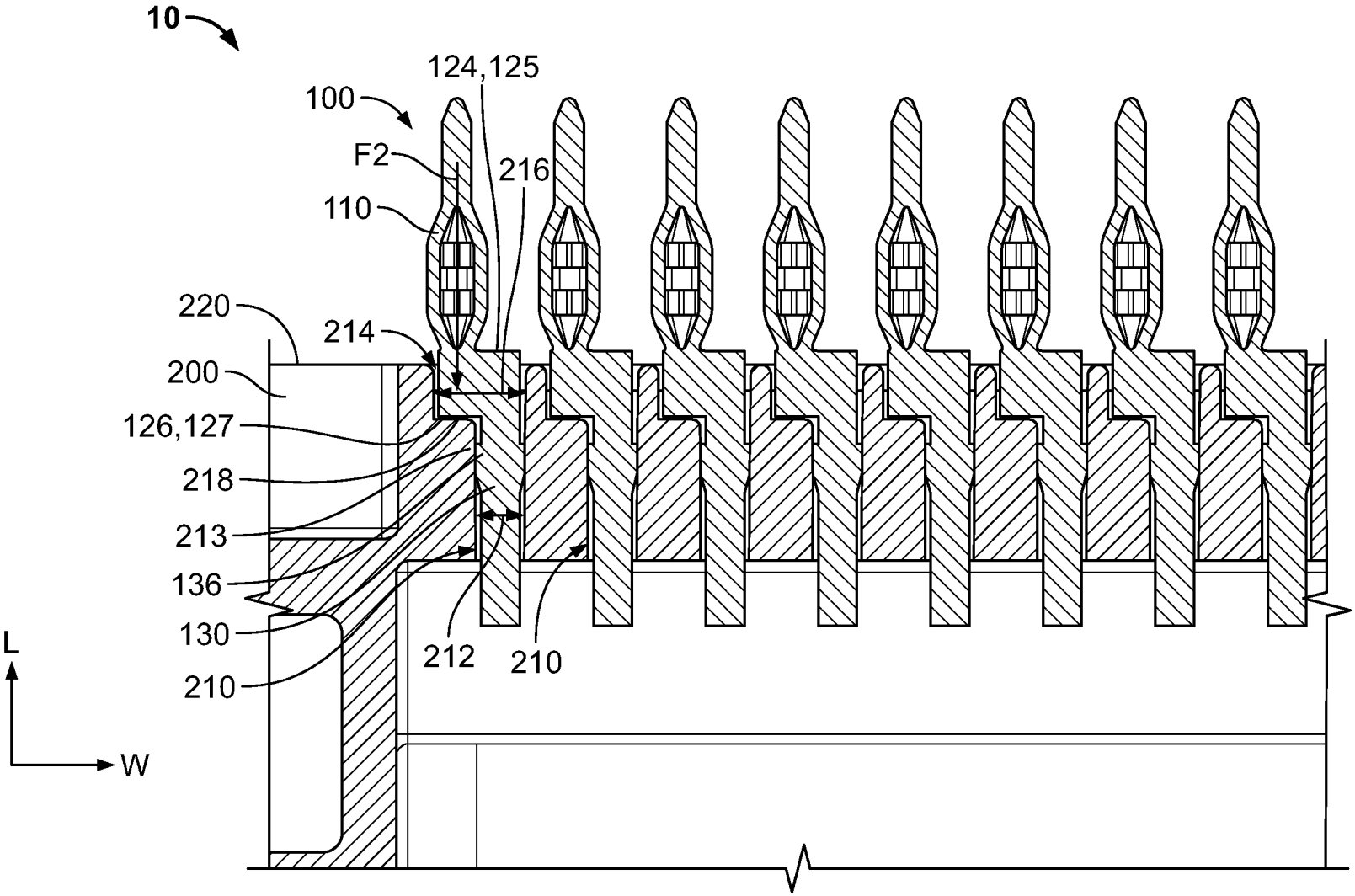
FIG. 4 is a sectional side view of the terminal of FIG. 1 in a fully inserted position in the housing.

A connector 10 according to an embodiment, as shown in FIGS. 2-4, comprises a housing 200 having a plurality of terminal receiving passageways 210 and a plurality of terminals 100, as described above with respect to FIG. 1, disposed in the terminal receiving passageways 210. In an exemplary embodiment, the plurality of terminals 100 are positioned at a 2.2 mm pitch in the housing 200.

In each of FIGS. 2-4, due to the number of components shown, only some of the plurality of terminals 100 and some of a plurality of terminal receiving passageways 210 are labeled with reference numbers for clarity of the drawings. The labeling and description of one of the terminals 100 applies to each of the plurality of terminals 100 and, likewise, the labeling and description of one of the terminal receiving passageways 210 applies to each of the plurality of terminal receiving passageways 210.

The plurality of terminal receiving passageways 210, as shown in FIG. 4, each extend through the housing 200 at least in the longitudinal direction L and have a seat 214 at an end of the terminal receiving passageway 210. The seat 214 has a seat width 216 wider than a passageway width 212 of the terminal receiving passageway 210 in the width direction W, forming a seat surface 218 on one side of the terminal receiving passageway 210 that extends in the width direction W.

Each of the plurality of terminals 100 is inserted into one of the plurality of terminal receiving passageways 210. The insertion of one terminal 100 into one of the plurality of terminal receiving passageways 210 will now be described in greater detail and applies to insertion of each of the terminals 100.

The terminal 100 is initially positioned in the terminal receiving passageway 210, as shown in FIGS. 2-4, with the first connection section 110 extending out from a first side 220 of the housing 200 that is positioned adjacent the seat 214.

A tooling 300, shown in FIG. 3, is used to push the terminal 100 to a fully inserted position in the terminal receiving passageway 210 shown in FIGS. 2 and 4. The tooling 300 is positioned over the terminal 100, straddling the first connection section 110, and engages the first surface 124 of the shoulder 120. A pushing force F1 from the tooling 300 in the longitudinal direction L is applied on a pushing shoulder 125 of the first surface 124 that is adjacent to the first connection section 110. The pushing shoulder 125, as shown in FIGS. 1 and 4, is aligned with the retention section 130 in the longitudinal direction L.

The pushing force F1 is distributed across a width of the pushing shoulder 125 in the width direction and pushes the terminal 100 into the terminal receiving passageway 210. The pushing force F1 pushes the terminal 100 into the terminal receiving passageway 210 until the second surface 126 abuts on the seat surface 218, as shown in FIG. 4, when the terminal 100 has reached the fully inserted position in the terminal receiving passageway 210. The offset position of the first connection section 110 with respect to the shoulder 120 provides a wide pushing shoulder 125 for the tooling 300 to bear upon. Further, the alignment of the pushing shoulder 125 with the retention section 130 prevents twisting or bending of the terminal 100 as it is pushed into the terminal receiving passageway 210.

In the fully inserted position of the terminal 100 in the terminal receiving passageway 210, as shown in FIGS. 2 and 4, the first connection section 110 protrudes from the first side 220 of the housing 200, the retention section 130 is positioned in the terminal receiving passageway 210 inside the housing 200, and the second connection section 140 protrudes from a second side 230 of the housing 200. As shown in FIG. 4, the protrusions 136 engage a pair of latch recesses 213 of the terminal receiving passageway 210 to retain the terminal 100 in the terminal receiving passageway 210.

In the embodiment shown in FIG. 2, the retention section 130 has the perpendicular bend portion 138 and the first connection section 110 and the second connection section 140 extend perpendicularly with respect to each other. The first side 220 of the housing 200 is perpendicular to the second side 230 in the shown embodiment. In other embodiments, the retention section 130 may be straight and the first side 220 from which the first connection section 110 protrudes may be parallel to the second side 230 from which the second connection section 140 protrudes.

With the terminals 100 in the fully inserted position in the terminal receiving passageways 210, the connector 10 can be connected to the first external component and the second external component. In an embodiment, the first connection section 110 of each of the plurality of terminals 100 is pressed into the first external component, for example, a printed circuit board. A pressing force F2 acting on the first connection section 110 when the first connection section 110 is pressed into the first external component is shown in FIG. 4.

The pressing force F2 is concentrated around the first connection central axis 112 and forces a support shoulder 127 on the second surface 126 that is adjacent to the retention section 130 against the seat surface 218. The support shoulder 127, as shown in FIGS. 1 and 4, is aligned with the first connection section 110 in the longitudinal direction L. The offset position of the retention section 130 with respect to the shoulder 120 provides a wide support shoulder 127 to bear upon the seat surface 218. Further, the alignment of the support shoulder 127 with the first connection section 110 prevents twisting or bending of the first connection section 110 as it receives a force during pressing.

Figure 5:
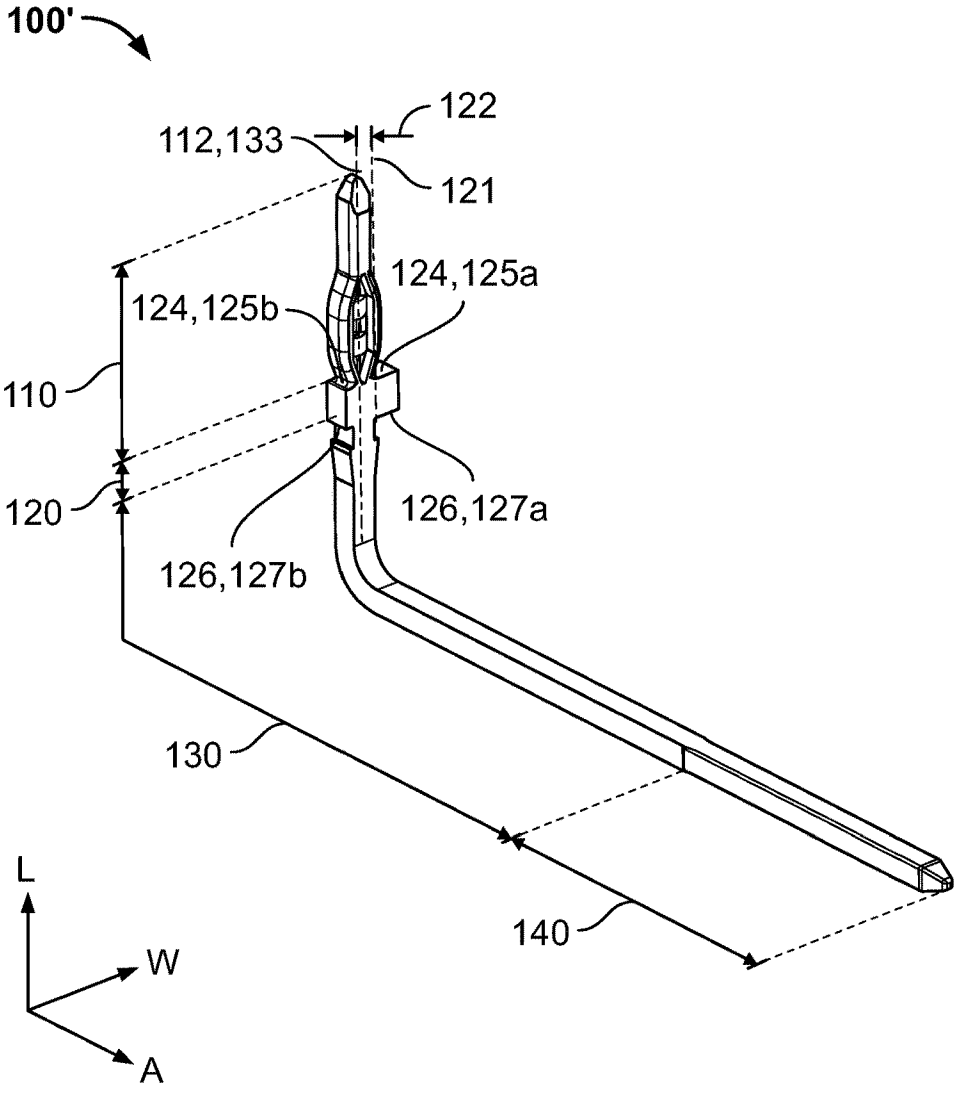
FIG. 5 is a perspective view of a terminal according to another embodiment.

A terminal 100' according to another embodiment is shown in FIG. 5. Like reference numbers refer to like elements and only the differences with respect to the terminal 100 shown in FIG. 1 will be described in detail herein.

In the terminal 100' shown in FIG. 5, the first connection central axis 112 is offset from the shoulder central axis 121 in the width direction W and the retention central axis 133 is offset from the shoulder central axis 121 in the width direction W. However, the retention central axis 133 is aligned with the first connection central axis 112 in the longitudinal direction L.

In the terminal 100', as shown in FIG. 5, the shoulder 120 protrudes beyond both sides of the first connection section 110 in the width direction W. The first surface 124 of the shoulder 120 has a first pushing shoulder 125*a* and a second pushing shoulder 125*b* arranged on opposite sides of the first connection section 110 in the width direction W. The first pushing shoulder 125*a* and the second pushing shoulder 125*b* both face in a same direction normal to the longitudinal direction L. In the shown embodiment, the first pushing shoulder 125*a* has a greater width in the width direction W than the second pushing shoulder 125*b*. In other embodiments, the second pushing shoulder 125*b* may have a greater width than the first pushing shoulder 125*a* in the width direction W. In the shown embodiment, the first pushing shoulder 125*a* and the second pushing shoulder 125*b* have a same thickness in the axial direction A. In another embodiment, the first pushing shoulder 125*a* and the second pushing shoulder 125*b* may have different thicknesses along the axial direction A.

The second surface 126 of the shoulder 120, as shown in FIG. 5, has a first support shoulder 127*a* and a second support shoulder 127*b* arranged on opposite sides of the first connection section 110 in the width direction W. The first support shoulder 127*a* and the second support shoulder 127*b* both face in a same direction normal to the longitudinal direction L and opposite to the first pushing shoulders 125*a*, 125*b*. In the shown embodiment, the first support shoulder 127*a* has a greater width in the width direction W than the second support shoulder 127*b*. In other embodiments, the second support shoulder 127*b* may have a greater width than the first support shoulder 127*a* in the width direction W.

In the embodiment shown in FIG. 5, the first support shoulder 127*a* and the second support shoulder 127*b* have a same thickness in the axial direction A. In another embodiment, the first support shoulder 127*a* and the second support shoulder 127*b* may have different thicknesses along the axial direction A. In an exemplary embodiment, a thickness of the first support shoulder 127*a* may be equal to a thickness of the first pushing shoulder 125*a* in the axial direction A and a thickness of the second support shoulder 127*b* may be equal to a thickness of the second pushing shoulder 125*b* in the axial direction A. In other embodiments, the thickness of any or all the shoulders 125*a*, 125*b*, 127*a*, 127*b* may differ from one another.

Figure 6:
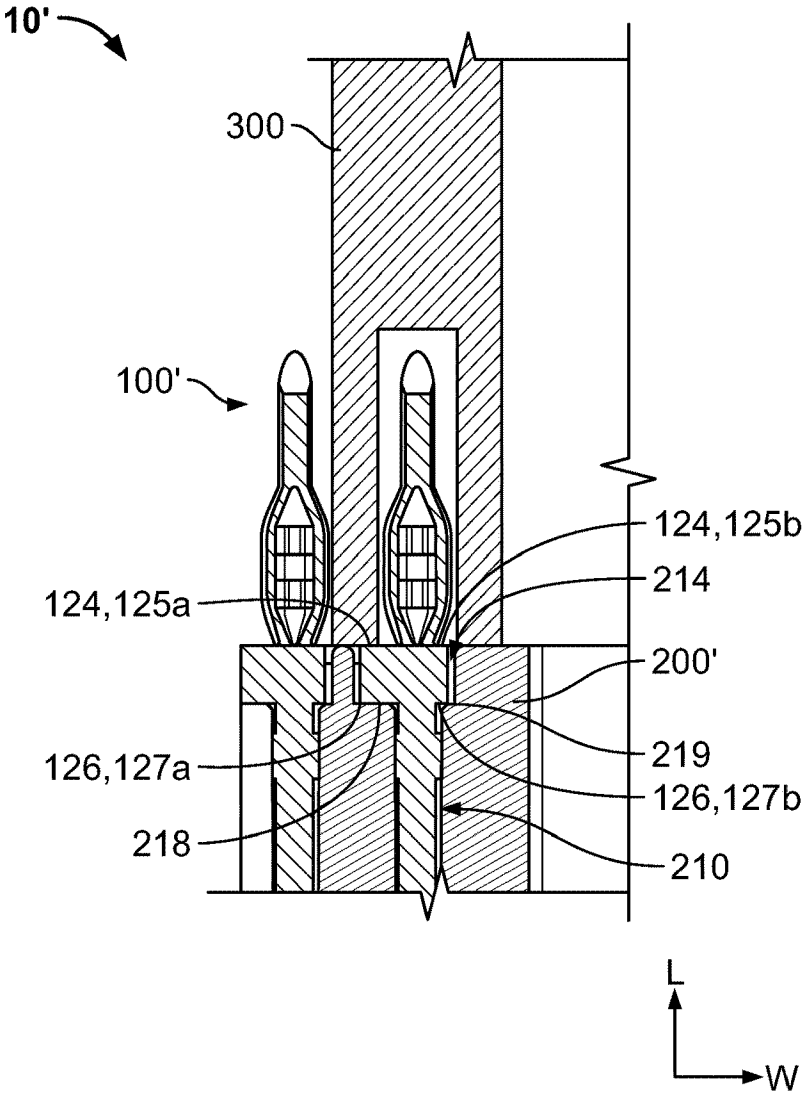
FIG. 6 is a sectional side view of a tooling pressing the terminal of FIG. 5 into the housing.

A connector 10' according to another embodiment is shown in FIG. 6. The connector 10' includes a housing 200' according to another embodiment and a plurality of terminals 100', as described above with respect to FIG. 5, disposed in the terminal receiving passageways 210. Like reference numbers refer to like elements and only the differences of the housing 200' with respect to the housing 200 shown in FIG. 2-4 will be described in detail herein.

In the terminal receiving passageway 210, as shown in FIG. 6, the seat 214 forms the seat surface 218 on one side of the terminal receiving passageway 210 in the width direction W and forms another seat surface 219 on an opposite side of the terminal receiving passageway 210 in the width direction W. In the shown embodiment, the seat surface 218 has a width greater than the another seat surface 219 in the width direction W. In another embodiment, the seat surface 218 may have a width smaller than the another seat surface 219 in the width direction W.

The terminal 100' is shown inserted into the terminal receiving passageway 210 of the housing 200 in FIG. 6. The tooling 300 engages the first surface 124 at the first pushing shoulder 125*a* to press the terminal 100' into the terminal receiving passageway 210. In an embodiment the tooling 300 can also engage the second pushing shoulder 125*b* of the terminal 100' to press the terminal 100' into the terminal receiving passageway 210, and may additionally engage the second pushing shoulder 125*b* of an adjacent terminal 100' to push the adjacent terminal 100' into an adjacent terminal receiving passageway 210.

The tooling 300 pushes the terminal 100' into the terminal receiving passageway 210 until the first support shoulder 127*a* of the second surface 126 abuts on the seat surface 218 and the second support shoulder 127*b* of the second surface 126 abuts on the another seat surface 219. In the embodiment shown in FIG. 6, the first pushing shoulder 125*a* is aligned with the first support shoulder 127*a* along the longitudinal direction L and the second pushing shoulder 125*b* is aligned with the second support shoulder 127*b* along the longitudinal direction L.

What is claimed is:

1. A terminal, comprising:

a first connection section having a first connection central axis extending centrally though the first connection section along a longitudinal direction;

a shoulder having a first surface extending normal to the longitudinal direction at an end of the first connection section, the shoulder has a width greater than the first connection section in a width direction perpendicular to the longitudinal direction and has a shoulder central axis extending centrally though the shoulder along the longitudinal direction that is offset from the first connection central axis in the width direction; and a retention section connected to a second surface of the shoulder opposite the first surface in the longitudinal direction, the second surface of the shoulder is normal to the longitudinal direction and faces in a direction opposite the first surface, the shoulder has a support shoulder on the second surface adjacent to the retention section, the first connection central axis extends through the support shoulder.

2. The terminal of claim 1, wherein the shoulder has a pushing shoulder on the first surface adjacent to the first connection section, the pushing shoulder is aligned with the retention section in the longitudinal direction.

3. The terminal of claim 1, wherein the retention section has a retention central axis extending centrally through the retention section along the longitudinal direction, the retention central axis is offset from the shoulder central axis in the width direction.

4. The terminal of claim 3, wherein the retention central axis is offset from the first connection central axis in the width direction.

5. The terminal of claim 4, wherein the shoulder central axis is offset from the first connection central axis by a first offset distance and the retention central axis is offset from the first connection central axis by a second offset distance greater than the first offset distance.

6. The terminal of claim 1, wherein the first connection section is a compliant pin having an elastic press-fit portion.

7. The terminal of claim 6, wherein the elastic press-fit portion has a deformable leg extending beyond a side surface of the shoulder in the width direction.

8. The terminal of claim 1, further comprising a second connection section connected to an end of the retention section opposite the shoulder, the second connection section is aligned with the retention section.

9. The terminal of claim 8, wherein the second connection section is a solid pin.

10. A connector, comprising:

a housing having a terminal receiving passageway; and a terminal disposed in the terminal receiving passageway, the terminal including a first connection section having a first connection central axis extending centrally though the first connection section along a longitudinal direction, a shoulder having a first surface extending normal to the longitudinal direction at an end of the first connection section, and a retention section connected to a second surface of the shoulder opposite the first surface in the longitudinal direction, the shoulder has a width greater than the first connection section in a width direction perpendicular to the longitudinal direction and has a shoulder central axis extending centrally though the shoulder along the longitudinal direction that is offset from the first connection central axis in the width direction, the second surface of the shoulder is normal to the longitudinal direction and faces in a direction opposite the first surface, the shoulder has a support shoulder on the second surface adjacent to the retention section, the first connection central axis extends through the support shoulder.

11. The connector of claim 10, wherein the shoulder has a pushing shoulder on the first surface adjacent to the first connection section, the pushing shoulder is aligned with the retention section in the longitudinal direction and abuts a tooling that pushes the terminal into the terminal receiving passageway.

12. The connector of claim 10, wherein the housing has a seat at an end of the terminal receiving passageway, the seat has a width wider than the terminal receiving passageway in the width direction.

13. The connector of claim 12, wherein the support shoulder abuts a surface of the seat.

14. The connector of claim 10, wherein the terminal includes a second connection section connected to an end of the retention section opposite the shoulder, the second connection section and the first connection section protrude from the housing.

15. The connector of claim 14, wherein the retention section has a protrusion engaging a latch recess of the terminal receiving passageway.

16. The connector of claim 14, wherein the retention section has a perpendicular bend portion, the first connection section and the second connection section extend perpendicularly with respect to each other.

* * * * *